US005884762A

United States Patent [19]

Roncato

[11] Patent Number: 5,884,762

[45] Date of Patent: Mar. 23, 1999

[54] MULTIFUNCTION CONTAINER, PARTICULARLY FOR SKI BOOTS, ICE SKATES OR ROLLER SKATES OF THE SINGLE WHEEL TYPE

[75] Inventor: Giovanni Roncato, Campodarsego, Italy

[73] Assignee: Valigeria Roncato S.p.A., Campodarsego, Italy

[21] Appl. No.: 930,907

[22] PCT Filed: Apr. 11, 1996

[86] PCT No.: PCT/IT96/00069

§ 371 Date: Dec. 12, 1997

§ 102(e) Date: Dec. 12, 1997

[87] PCT Pub. No.: WO96/32029

PCT Pub. Date: Oct. 17, 1996

[30] Foreign Application Priority Data

Apr. 12, 1995 [IT] Italy ..... TV95U0024
Mar. 26, 1996 [IT] Italy ..... TV96U0020

[51] Int. Cl.[6] ..... B65D 85/18

[52] U.S. Cl. ..... 206/315.1; 206/278; 206/792

[58] Field of Search ..... 206/315.1, 278, 206/292, 294, 296; 280/814; 211/38; D3/261

[56] References Cited

U.S. PATENT DOCUMENTS

| | | | |
|---|---|---|---|
| D. 362,544 | 9/1995 | Vincent | D3/261 |
| D. 366,360 | 1/1996 | Vincent | D3/261 |
| 2,672,263 | 3/1954 | Alber | 206/315.1 X |
| 3,348,665 | 10/1967 | Andrefich | 206/315.1 |
| 3,394,781 | 7/1968 | Woolworth | 206/315.1 |
| 3,399,750 | 9/1968 | Woolworth | 206/315.1 |
| 3,414,093 | 12/1968 | Chostner | 206/292 X |
| 3,749,232 | 7/1973 | Craig | 206/278 |
| 4,131,196 | 12/1978 | Cantor | 206/278 |
| 5,390,786 | 2/1995 | Challoner et al. | 206/278 |
| 5,456,353 | 10/1995 | Challoner et al. | 206/292 |

FOREIGN PATENT DOCUMENTS

| | | | |
|---|---|---|---|
| 0002888 | of 1896 | United Kingdom | 206/315.1 |

*Primary Examiner*—Bryon P. Gehman
*Attorney, Agent, or Firm*—Wenderoth, Lind & Ponack, L.L.P.

[57] ABSTRACT

A mulitfunction container has a rigid hull made of a plastic material. The hull has an opening on the back part thereof, an upper part, a front, a base, and a top release button on the upper part. The shape of the hull resembles a boot. The front of the hull has the shape of the tip of a shoe, with the opening being located at the back of the hull opposite to the shape of the tip of the shoe. The hull is able to receive a pair of boots in an upright position. An external handle is provided in the hull for carrying the hull. An access shutter is hinged to the hull so as to be capable of tilting backwards from a position closing the opening to a position that exposes the opening. An upper bent end of the access shutter terminates in a fastening tongue cooperable with the top release button. The clog on the base of the hull engages the ground, the clog having small holes and forming a space internal to the container. Sponge material is located in the hull at a position corresponding to the clog and separated from the remaining internal space in the hull by an extractable grid fixed internally of the hull.

18 Claims, 4 Drawing Sheets

MULTIFUNCTION CONTAINER, PARTICULARLY FOR SKI BOOTS, ICE SKATES OR ROLLER SKATES OF THE SINGLE WHEEL TYPE

TECHNICAL FIELD

This invention relates to a multifunction container, particularly one for ski boots. The innovation finds particular, even if not exclusive, application among accessories and promotional articles in general destined for the sports shoes sector.

BACKGROUND ART

In the prior art, ski boots, ice skates and roller skates are known. These are essentially characterized by a structure that is somewhat heavy and undoubtedly of a certain dimension, which is the source of various problems.

Firstly, transport to and from the place destined for the exercise of the sporting activity is a problem. Users with cars certainly feel less objective discomfort. However, they are mostly obliged to pick up the boots from the basement and introduce them, as they are and higgledy piggledy, into the trunk of the car. Having arrived at the destination, they have to take the shoes and put them on, which in the meantime, not being heated by the internal heating of the car, will have reached a temperature close to that of the environment.

A first drawback, therefore, is the sudden displacement of the shoes, which being rigid, besides causing noise during the drive and therefore distraction of the driver, can be the cause of slight damage to the internal parts of the trunk or to other objects contained therein.

Secondly, the necessity of being able to put the shoe inside the trunk at least at a lukewarm temperature is known to all. In order to facilitate the fitting and shaping of the shoe, an operation that should be carried out is removing the shoe and introducing it into the cabin of the car, separated by the hull. However, because of the discomfort and complexity of the operation, as both the extraction and the reintroduction is difficult, the majority of people do not do it, adapting themselves instead to wearing the shoes as they are.

Regarding the phase following use, the main drawback is dictated by the fact that the boots are introduced into the trunk of the car dirty and full of snow, notwithstanding that they may be shaken to remove the more consistent parts. If the support surface of the shoe is soaked, one will have persistent humidity on the inside of the ski boot along with the emission of bad odors. This will also take place in the trunk of the car, and also will wet the surrounding objects.

A solution has been proposed by the use of well known technical bags supplied with ski boots or placed on the market as promotional articles. These are formed of a soft container, obtained by sewing a fabric or cloth that is externally elasticized. It is provided, on an upper part, with two robust grip handles and a zipper, generally placed in the center, that allows the total opening of the bag. The necessity of using the bag is dictated above all in those transfers carried out by the use of public transport, e.g. a bus, where the boots can be separated by other luggage amassed in common.

A first drawback is that, because of the stacking of bags together, with the jerks of the bus breakage can be caused, at times irreparable, at least with respect to the cloth of the bags. Secondly, at the end of the use, the boots placed in the bag impregnate at least internally the fabric, contributing to the formation of humidity that persists also inside the boots.

Finally, the traditional type of bag, due to the material used, is subjected to getting dirty somewhat frequently, one not being able to clean it with ease.

Regarding storage of the boots during periods of non-use, and not only seasonal periods, one prefers as a rule a tidy arrangement on common shelves or other shelves in general found in the basement of the house. This does not allow, notwithstanding personal attention, the prevention of the shoes from getting dusty. Unavoidably during the period of non-use, dust will form, not only on the outside, but also, and above all, on the inside.

An alternative can consist in providing a suitable cloth or sheet, for example wholly wrapping the row of boots of an average family.

A second and more effective alternative consists in rearranging the boots on the inside of the original packaging. This concerns, in more detail, cardboard boxes of great thickness, obtained by convenient blanks, which realize two half-hulls hinged on one side, the other side providing tabs to allow locking. Along one side of the structure, a retractable handle of plastic material is additionally provided, which facilitates transport.

The drawbacks of this solution consist essentially in the excessive dimensions of the cardboard boxes, as they are structured to accommodate the couple of boots in a position that is extended and opposite according to the more traditional scheme. Secondly, the material of which they are formed does not allow for ordinary transport of the shoes, because wet or even only damp shoes cannot be introduced, requiring the boots therefore to be perfectly dried.

The same drawbacks can be verified for other sporting activities, such as those in which an internal shoe is provided. This is case for example for single blade roller skates or ice skates, e.g. ice hockey, artistic skating, and other activities, where it is common to carry one's own equipment.

In both cases the drawbacks, if compared to the transport solution of the ski boot, are greater, as, when carried in a bag of the traditional type, or one not even rigid, the shoes because of their substructure, will engage on the bottom of the bag in a non-uniform way, stressing only a minimum part of the base of the bag. This naturally causes an incorrect distribution of the load, which above all is free to move on the inside of the bag. In addition to the drawbacks already detected, a recurrent wear of the parts more stressed will result, and because of irregular tension, frequent breakage results, even of the handles.

CH-A-547 066 discloses a multifunction container comprising a hull that is rigid, aerated and formed of plastic material, and a closable access shutter hinged to the hull and provided with locking means and having a handle. This container is realized as a parallelepiped case opening like a suitcase and being able to contain a pair of boots, placed on the same plane, one opposite the other, divided by a diagonal diaphragm to avoid position difficulty. This solution is, however, bulky and not practical, because the boots:

- are difficult to insert and remove, because of the opposite placement; and
- must be placed or removed from above, increasing the difficulty.

SUMMARY OF THE INVENTION

The aim of this invention is to avoid the above-mentioned drawbacks.

This and other aims are reached with this invention, according to the characteristics as included claims, and solving the problems with a multifunction container. The container is particularly for ski boots, ice skates and single blade roller skates. A hull, rigid and aerated, is formed of plastic material, provided with an opening and closable with at least one corresponding access shutter. The access shutter is hinged to the hull, and closable on an upper part by a locking means. The hull is provided externally with a handle.

The shape of the hull, in side view, resembles a boot having in front the shape of the tip of a shoe, and is able to receive a closed pair of boots in an upright position. The opening is placed at the back, opposite to the tip shape, the access shutter being hinged in opposition sideways for rotation from a closure position to an opening position, tipping backwards. The opening extends the respective closure upwards by a bent end, the bent end terminating with a fastening tongue, cooperating with a top release button on the upper part of the hull.

In this way, besides solving the drawbacks raised in the preceding solutions, it is possible to obtain a container particularly useful, as the boots can be easily inserted and removed in a pair in the exact upright position, and dirt from the bottom of the boots remains on the bottom of the container, where a hollow is provided. It allows an easier transport, being able to be placed tidily on the inside of the trunk of the car, eventually also a with modularization function being able to be hooked to a similar container. It avoids the dispersion in the environment of humidity and does not impregnate the interior surfaces of the car with water. The insulating material with which it may be obtained allows the maintenance of the shoes at an acceptable temperature for fitting. The particular sturdiness that derives from the rigidity of the structure facilitates transport in conditions not particularly easy, such as the higgledy piggledy position in common housings. It allows finally a rational positioning, protected from dust and humidity during the periods of non-use, lending itself to the eventuality of immediate use.

BRIEF DESCRIPTION OF DRAWINGS

These and other advantages will be shown in the following specific description of a preferred solution with the help of the included drawings, whose details should not be intended as limitative, but preferably illustrative.

DETAILED DESCRIPTION OF THE PREFERRED EMBODIMENTS

Figure 1:
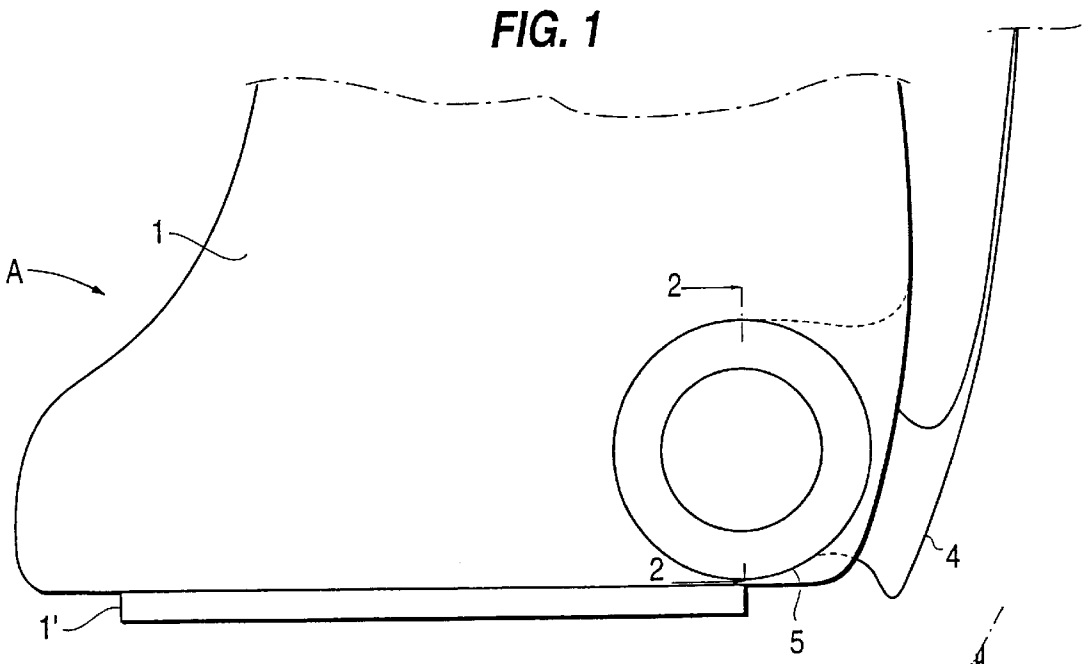
FIG. 1 is a partial view of a container, represented in a schematic and sideways manner with a partially opened access shutter highlig d on a back side.
Figure 2:
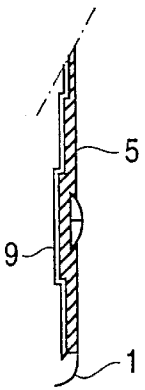
FIG. 2 represents a sectional view of a hinge of the access shutter of FIG. 1 taken along line A—A.
Figure 3:
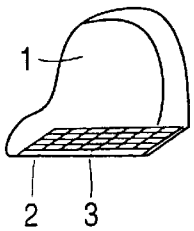
FIG. 3 represents a schematic view of an ideal shape of the container where an internal part forming the bottom of the container and a support for shoes with a flat bottom is highlighted.
Figure 4:
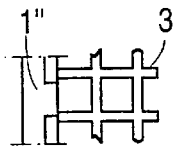
FIG. 4 is a partial view of a reticle or grid applied on the bottom of the container.

Referring to the Figures, one can see an aerated container (A), preferably formed of rigid plastic material, and possibly also insulated. It is made up essentially of a hull (1) having a rather rounded shape that, as seen from the side, resembles in a certain way the shape of a shoe.

The base of the hull (1) is provided with a clog (1') for placing on the ground, which is provided with small holes. The ends of the hull protrude, heel and toe, over the clog.

The purpose of the clog (1'), is substantially to obtain an internal space, internally to the container, where a sponge (2) can be housed, held on the bottom of the container by a removable reticle or grid (3), also of plastic material.

The grid (3) is flexible and able to be easily introduced and to adapt to the shape of the bottom of the boots. After insertion the grid can be encased beneath an encasing internal rim (1") formed in a discontinuous way on the internal perimeter of the hull (1)

For allowing the introduction to the container (1) of at least one pair of ski boots, roller skates or ice skates, a back access shutter (4) is provided, which is downwardly hinged on both sides of the hull.

On the sides of the hull (1) and in logical correspondence, suitable slots are provided on the inside of which are housed opposed side shutter hinges (5) that allow the opening of the shutter (4). The shape of the access shutter (4) extends over both the back of the container (1, FIG. 1) and its upper part (Ref.4–4', FIG. 5) of the container, obtaining a turned-up surface (4') almost orthogonal to the back on the upper part, following the shape of the container (A-1).

The upper end of the access shutter (4–4') is equipped, centrally, with a tongue (6) on the same plane and provided with a lock tooth (6') to lock on the inside of a corresponding engagement means (7), made up essentially of a harpoon disengageable by the action of the fingers.

Figure 7:
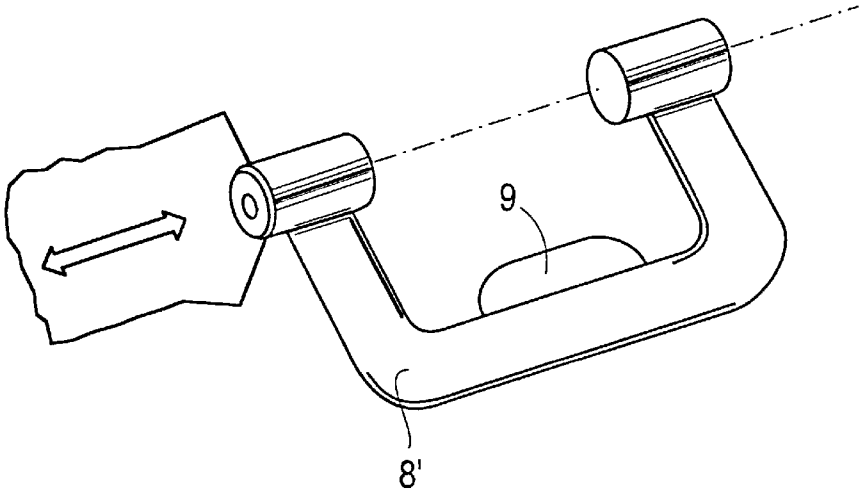
FIG. 7 shows an encaseable handle for lifting and transporting of the container.

On the upper part of the container hull, in position next to the lock (7), or almost straddling it, a handle (8') of the encaseable type is also provided (8'–9, FIG. 7).

The handle of the disappearing type (8') is obtained by an encasing shape in the upper part of the hull (1). The encasing shape is a hollow lowered that resembles the shape of the handle so that, in a lowered position, the handle does not offer protrusive surfaces. In order to facilitate the grip, and in proximity to the cross piece of the handle (8'), a niche (9) may be provided on the hull (1), so as to allow the introduction of the fingers.

Finally, in a preferred solution, a second shutter (10) may be provided on the opposed side, e.g. on the front and upper part of the container (e.g. the position of the instep of the foot), for communication with the inside of the container (1), for example to introduce gloves.

The hinging of this second access shutter (10) is provided downwardly, with a respective lock, while the upper part of the second access shutter provides a grip (11) for closing it. A hole (12) is provided in the locking position (11) allowing transpiration and insertion of the finger to allow opening of the second shutter.

Figure 6:
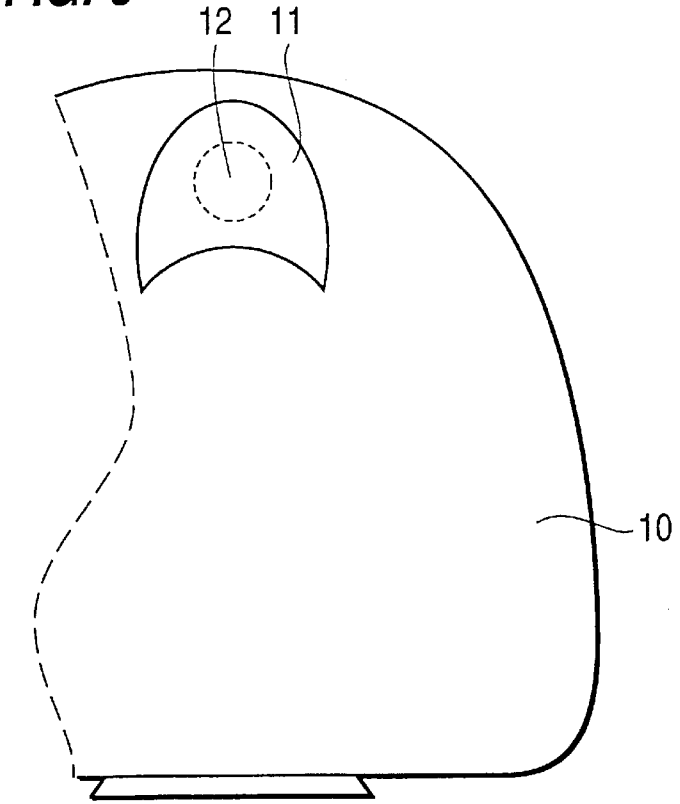
FIG. 6 is a partial view of a second shutter hinged on the front part of tainer.
Figure 9:
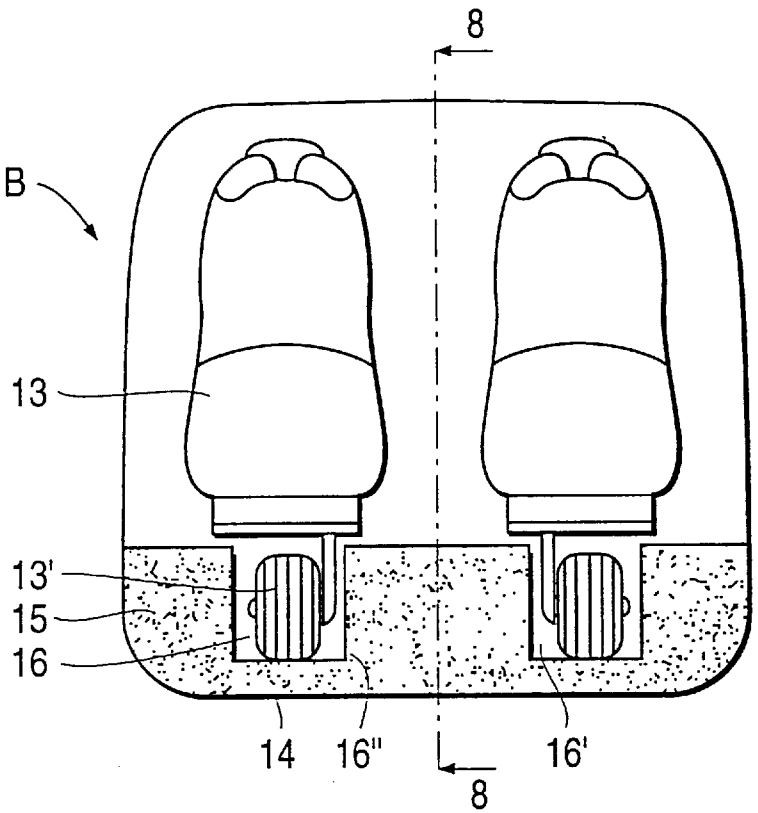
FIG. 9 shows a back view of the container with its back access shutter opened (not shown), having a pair of roller skates inside and wherein the respective rollers are encased in the thickness of the shaped base of the container, and taken along line B—B of FIG. 8.
Figure 8:
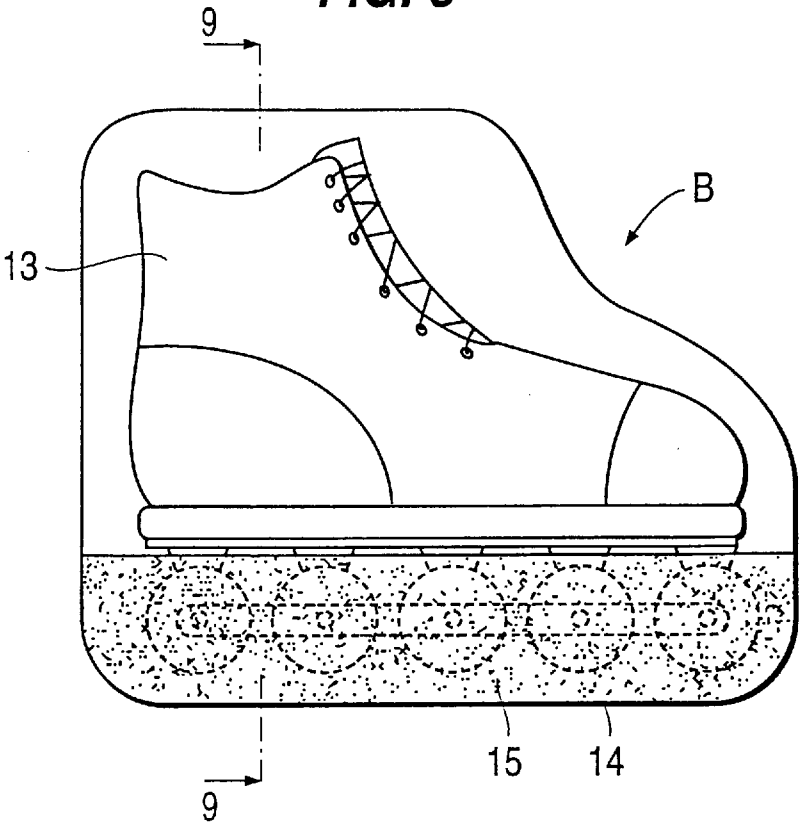
FIG. 8 shows a schematic sectional view of the container having a roll skate inside, and taken along line A—A of FIG. 9.

FIG. 6 shows only one part of the front shape of the container (1) with its respective second shutter (10), the left side being cut away. The cutting is indicated by a tortuous bold broken line.

Figure 5:
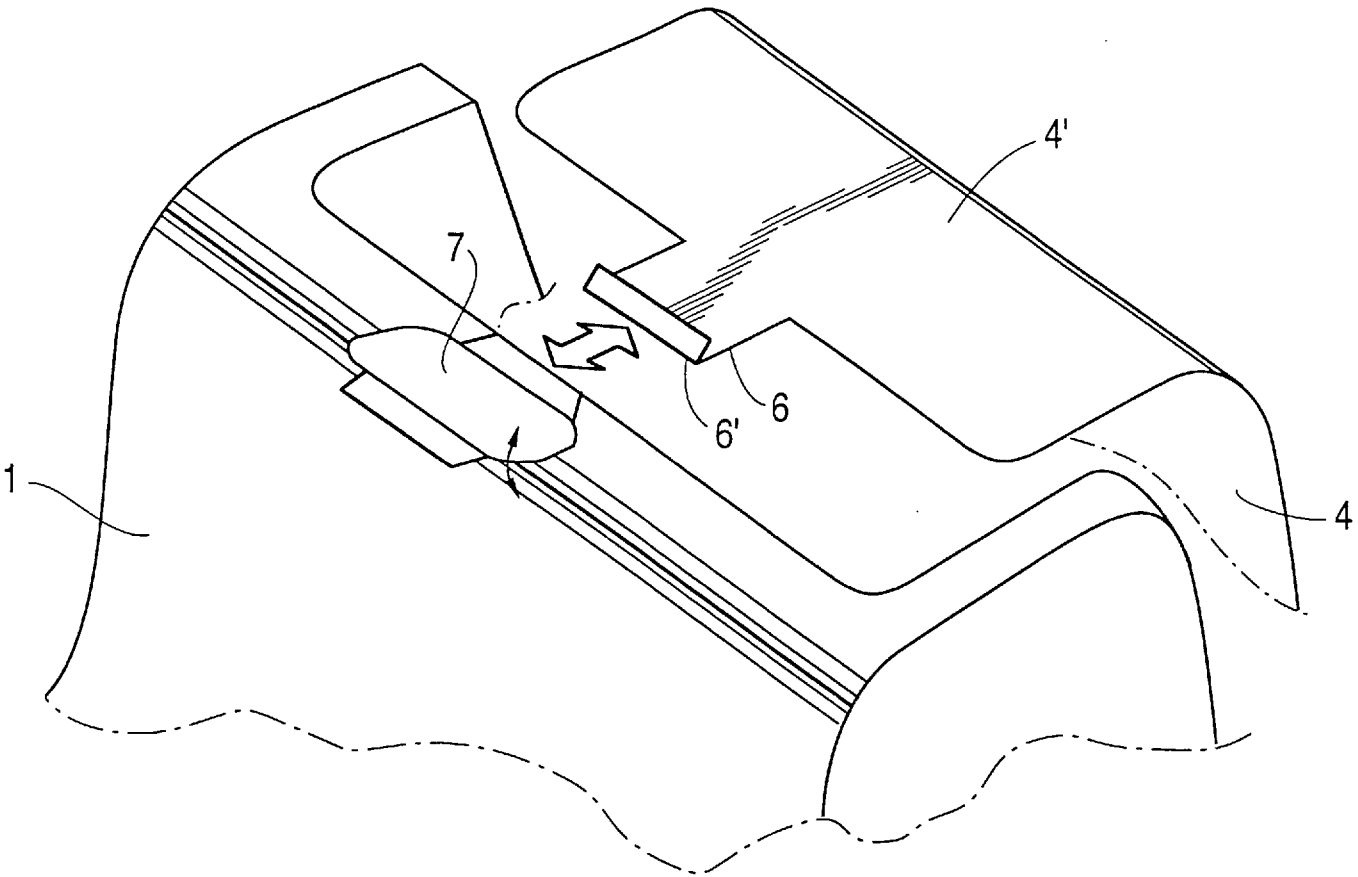
FIG. 5 is a partial view of an upper part of the container, in which a locking system of the access shutter is shown.

Similarly, the first access shutter (4'–4) extends backwards downwardly, being interrupted by a similar tortuous bold broken line in FIG. 5, and likewise for the hull of the container. In other words, FIG. 5 completes the missing upper part of FIG. 1, even if one is represented in a perspective way and the other sideways.

For ice skates or for single blade roller skates (13–13'), the shape of the container hull (1) can remain the same (B) as the first one (A). The same goes for the shutters. The bottom (14) of the container provides on the inside a removable layer (15), which may be of absorbent and soft material such as a sponge, or of semirigid material, provided that in both cases longitudinal slot seats (16, 16') are allowed or provided.

The slot seats (16, 16'), a bottom (16") of which remains away from the bottom (14) of the container (A/B-1), have a size, respectively in length and in height, calculated based on the average space occupied by the wheels or blade (13').

Finally, in an alternative solution to the preceding one, this slot seat layer (15) can be obtained in the hull (1), not interfering in any way with the lodging of ski boots.

I claim:

1. A multifunction container, comprising:

a rigid hull made of a plastic material, said hull having an opening therein, an upper part, a front, a back, a base, a top release button on the upper part, and a shape which in side view resembles a boot, including the front having the shape of the tip of a shoe, said opening being located at the back of said hull opposite to said shape of the tip of a shoe, and said hull being able to receive a pair of boots in an upright position;

an external handle on said hull;

an access shutter hinged on said hull so as to be capable of tilting backwards from a position closing said opening to a position exposing said opening, said access shutter comprising an upper bent end terminating in a fastening tongue that is cooperable with said top release button;

a clog on said base of said hull for engaging the ground, said clog comprising small holes and forming a space internal to said container; and an expanded flexible plastic material located in said hull at a position corresponding to said clog and separated from remaining internal space in said hull by an extractable grid fixed internally of said hull.

2. The container of claim 1, wherein said hull has an internal perimeter comprising discontinuous protrusions fixing said grid in place.

3. The container of claim 1, wherein said sponge material is located in said internal space.

4. The container of claim 1, wherein said access shutter is hinged on opposite sides of said hull, said hull comprising corresponding slots on opposite sides thereof receiving respective hinges that hingedly connect said access shutter to said hull.

5. The container of claim 1, wherein said access shutter has a shape corresponding to the back of said hull and the upper part of said hull, including a back surface corresponding to the back of said hull and a turned-up surface on said bent end almost orthogonal to the back surface of said access shutter.

6. The container of claim 1, wherein said hull has a hollow in the upper part thereof having a shape resembling said handle, and said handle is hinged on the upper part of said hull so as to be rotatable and encaseable by said hollow formed in said hull.

7. The container of claim 1, wherein said hollow has an intermediate portion comprising a niche so as to allow the insertion of a finger to lift said handle.

8. The container of claim 1, and further comprising a second opening in said hull and a second shutter positioned on said hull for opening and closing said second opening, said second opening being positioned on the front of said hull.

9. The container of claim 8, and further comprising a grip on said hull capable of receiving a finger for opening said second shutter, said grip comprising an aeration hole.

10. The container of claim 1, wherein said hull has a removable layer internally thereof adjacent to said base.

11. The container of claim 1, wherein said hull has an internal bottom comprising longitudinal grooves extending from the back toward the front of said hull for receiving blades or wheels.

12. The container of claim 11, wherein said longitudinal grooves have respective bottoms separated from said base.

13. The container of claim 11, wherein said longitudinal grooves have a U-shaped cross section.

14. The container of claim 11, wherein said longitudinal grooves are formed integrally with the base of said hull.

15. The container of claim 11, wherein said longitudinal grooves are formed by an expanded flexible plastic material.

16. A multifunction container, comprising:

a rigid hull made of a plastic material comprising an upper part, a front, a back, a base, sides extending from said front to said back and upward from said base to said upper part, and a shape which in side view resembles a boot, including the front having the shape of the tip of a shoe with the shoe pointing in a forward direction away from said back of said hull, said hull having an opening located at said back of said hull opposite to said shape of the tip of a shoe and rearward of said sides, and said hull being able to receive a pair of boots in an upright position;

an external handle on said hull; and an access shutter hinged on said hull at said back of said hull and on said sides of said hull on opposite sides of said opening so as to be capable of tilting rearwards from a position closing said opening to a position exposing said opening.

17. The container of claim 16, and further comprising a means for locking said access shutter to said hull.

18. The container of claim 16, and further comprising a clog on said base for engaging the ground, said clog having holes communicating the interior of said hull with the exterior thereof.

* * * * *